United States Patent [19]

Sheber

[11] 4,271,111

[45] Jun. 2, 1981

[54] EMBOSSED CONCRETE BUILDING PANELS AND METHOD

[76] Inventor: Thomas F. Sheber, 640 W. Chapala Dr., Tucson, Ariz. 85704

[21] Appl. No.: 960,041

[22] Filed: Nov. 13, 1978

[51] Int. Cl.[3] ..... B28B 1/08

[52] U.S. Cl. ..... 264/71; 264/69; 264/226; 264/293; 264/316; 264/333; 264/336

[58] Field of Search ..... 264/284, 293, 333, 316, 264/69, 71, 336, 226; 52/367

[56] References Cited

U.S. PATENT DOCUMENTS

| | | | |
|---|---|---|---|
| 336,055 | 2/1886 | Krispin | 264/293 X |
| 1,387,861 | 8/1921 | Mitchell | 264/284 |
| 2,818,824 | 1/1958 | Read | 264/284 X |
| 3,217,375 | 11/1965 | Kinnard | 264/256 X |
| 3,299,803 | 1/1967 | Taylor | 264/293 X |
| 3,775,529 | 11/1973 | Steenson | 264/293 X |
| 3,775,922 | 12/1973 | Myers | 52/367 |
| 3,910,711 | 10/1975 | Moorhead | 264/316 X |

*Primary Examiner*—Thomas P. Pavelko

*Attorney, Agent, or Firm*—Cahill, Sutton & Thomas

[57] ABSTRACT

Concrete building panels include a decorative embossed pattern on an outer surface. A plurality of concrete reinforcing ribs are disposed along an inner surface of the concrete building panels. Nailing strips are anchored into tips of the respective concrete reinforcing ribs. A method for making the building panels include a step of placing anchored nailing strips into tapered rib sections of a horizontal fiberglass mold is disclosed wherein reinforcing bars and mesh and moist concrete are placed into the mold and allowed to cure until the exposed upper surface of the moist concrete is plastically deformable. The horizontal mold is passed beneath a rotating embossing roller having a cylindrical embossing pattern thereon. The plastically deformable concrete contacts the embossing pattern, producing a complementary pattern on the concrete surface. The embossed concrete is cured in the mold to produce the building panel. The concrete building panel is then separated from the mold.

8 Claims, 10 Drawing Figures

EMBOSSED CONCRETE BUILDING PANELS AND METHOD

BACKGROUND OF THE INVENTION

1. Field of the Invention

The invention relates to preformed, reinforced, ribbed and embossed concrete building panels and, more particularly, to methods of making such concrete building panels.

2. Description of the Prior Art

Preformed, reinforced concrete panels have previously been utilized in construction of private residences and large commercial buildings. Such concrete panels have been formed in vertical or horizontal molds or forms, some of which molds or forms have contained a decorative pattern. Such decorative patterns impress a complementary pattern on moist concrete placed into the molds or forms. Reinforcing metal material in the form of rods and/or mesh is generally positioned in the molds before the moist concrete is placed in the mold. The moist concrete remains in the mold until hardened and is then separated from the mold.

The preformed concrete panels known in the prior art have not found popularity in the residential building field for a number of reasons. Such prior concrete panels are unduly heavy due to their thickness. Such concrete panels do not have ornamental surface patterns which are appealing to the average home buyer. Further, such concrete panels are not easily utilized in construction of residences because of their weight and the difficulty of attaching interior wall materials and insulation thereto. U.S. Pat. No. 1,525,797 discloses a wall section useable in construction of residences, wherein studs are anchored into a reinforced concrete slab. The resulting concrete panel thus consists of a slab of reinforced concrete having spaced studs anchored therein serving both as reinforcing beams and as nailing strips for attaching interior wall material. However, the anchors extending into the reinforced concrete slab may be severely stressed if the studs become twisted or warped and may expand or contract at a different rate than the concrete. This tends to weaken the concrete slab. Further, the studs which are sufficiently thick to adequately reinforce the concrete slab to which the studs are anchored are quite expensive. The concrete slab portion is thicker than would be necessary if high stresses did not occur at the points at which the studs are anchored to the concrete slab. The exterior of the disclosed concrete building panel is unpatterned, so that either siding or stucco must be applied thereto to provide an attractive finish. The method (disclosed in the above mentioned patent) of making the concrete panels by burying the pre-positioned studs in sand with anchors extending upwardly and placing reinforcing metal mesh and moist aggregate over the sand mold area is archaic and unsuitable for producing low cost concrete building panels. U.S. Pat. Nos. 1,627,171, 2,642,645, 1,211,953, 1,523,628, 1,228,353 and 900,778 were uncovered in a novelty search directed to concrete building walls and panels, but are deemed less relevant than the first mentioned patent and will not be discussed in detail.

Various methods of embossing surfaces of moist concrete other than by providing patterns on molds into which the moist concrete is poured are known. Some of the methods involve the use of patterned rollers which are rolled over the surface of the moist concrete to impress a complementary pattern therein. U.S. Pat. No. 3,910,711 discloses a tractor-like device utilizing a bladed roller defining a pattern. The tractor-like device is driven over the moist concrete. A plastic film is dispensed over the surface of the moist concrete and the bladed roller rolls over the plastic film, which is then lifted. The plastic film prevents the moist concrete from sticking to the blades of the roller. The disclosed apparatus and method disclosed in the foregoing patent are suitable for patterning thick, poured-in-place concrete slabs, but are not at all suitable for patterning thin reinforced concrete building panels which are formed in horizontal molds. The weight of the tractor-like device and the difficulties that would be involved in driving it over molds for forming building panels would be totally impractical.

U.S. Pat. Nos. 1,283,770, 2,154,940, 3,801,211, 2,152,264, 551,205, 680,051 and 534,071 disclose various devices utilizing patterned rollers to produce patterns on various materials, but are deemed less relevant than U.S. Pat. No. 3,910,711 to the invention disclosed in the present application.

Accordingly, it is an object of the invention to provide a low cost reinforced concrete building panel and method.

It is another object of the invention to provide a low cost reinforced concrete building panel and method providing an attractive patterned outer surface.

It is yet another object of the invention to provide a low cost reinforced concrete building panel which is readily compatible with residential construction techniques.

Still another object of the invention is to provide a lightweight reinforced concrete building panel which is sufficiently rigid for use in residential construction.

A further object of the invention is to provide an economical method of embossing various patterns on surfaces of concrete building panels during the manufacture of the concrete building panels.

A still further object of the invention is to provide a method of embossing patterns which have an appearance similar to pre-existing walls constructed utilizing conventional building techniques.

SUMMARY OF THE INVENTION

Briefly described and in accordance with one embodiment thereof, the invention provides a preformed concrete building panel having a wall section, a plurality of reinforcing ribs disposed along an inner surface of and integrally formed with the wall section, and a plurality of nailing strips anchored along an outermost surface of each of the reinforcing ribs. Reinforcing mesh is disposed within the wall section to reinforce the concrete of which the wall section is composed. A plurality of reinforcing bars are disposed in the respective reinforcing ribs for reinforcing the concrete of which the reinforcing ribs are composed. Anchors extending into the respective nailing strips and into the concrete of which the respective ribs are composed perform the function of anchoring the nailing strips to the respective reinforcing ribs. Reinforcing links anchor the respective reinforcing bars to the anchoring mesh. An outer surface of the wall section contains an embossed decorative pattern. Entire wall sections can be constituted of a single preformed concrete building panel of the present invention. Suitable openings for doorways and windows are provided in the building panels. Interior wallboard can be easily attached to the nailing strips. Insulation can be provided within the volumes bounded by the wall board, the inner surface, and the reinforcing ribs. An embossed pattern is disposed in the outer surface of the wall section.

In accordance with one embodiment of the invention, the concrete building panels are formed by placing anti-sticking material, such as silicone lubricant and/or a thin sheet of plastic material, on the inside surfaces of a fiberglass mold defining the reinforcing ribs and the inner surface of the building panels. The reinforcing mesh, reinforcing bars and nailing strips with upwardly extending anchors are placed in the mold. Wet concrete is placed in the mold and allowed to cure for a predetermined amount of time adequate to enable the outer surface of the concrete to become plastically deformable. The mold, which can be positioned in a carrier, is conveyed to an embossing machine having means for propelling the carrier and mold at a predetermined velocity. The embossing machine includes an embossing roller having a cylindrical embossing pattern thereon rotating with a pattern velocity equal to the velocity of the mold. A suitable anti-sticking substance such as silicone lubricant and/or a thin sheet of plastic material is applied to the embossing surface and/or the upper surface of the moist concrete. The rotating embossing pattern is then impressed into the upper surface of the moist concrete, plastically deforming it and producing a complementary pattern on the concrete surface. The molds are then stored and cured for a predetermined amount of time, whereby the moist concrete hardens to form the concrete building panels. The concrete building panels are then separated from the molds. In one embodiment of the invention, inflatable tubes are disposed beneath the nailing strips in the reinforcing rib portions of the mold. The concrete panel is separated from the mold by inflating the inflatable tubes. In another embodiment of the invention, the embossing pattern is produced on a flexible durable embossing sheet by casting or pressing a plastically deformable substance against a pre-existing wall having a desirable decorative pattern. The plastically deformable substance is cured and utilized to make the embossing sheet, which is wrapped around and attached to the embossing roller.

DESCRIPTION OF THE INVENTION

The present invention relates to preformed concrete building panels suitable for use in constructing residential buildings and to apparatus and methods for making such preformed panels. However, before describing the apparatus and method for making such concrete panels, it will be helpful to describe the detailed structures of the concrete panels and the molds utilized for making the concrete panels.

Figure 8:
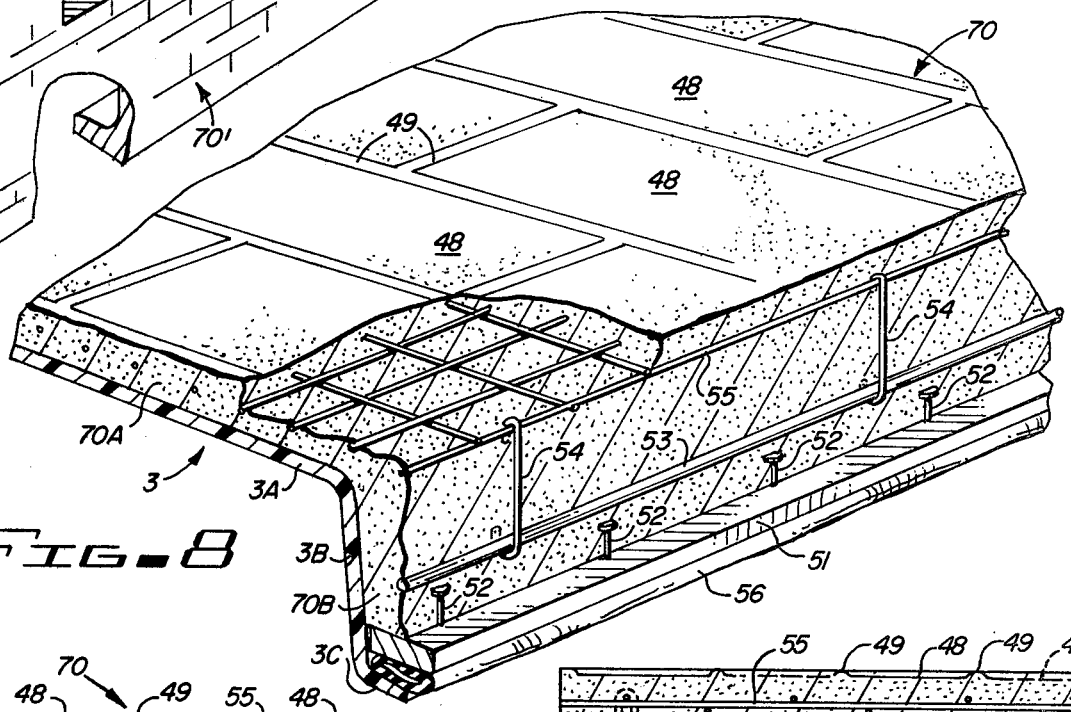
FIG. 8 is a partial perspective sectional view of a fiberglass mold containing reinforcing metal, a nailing strip, moist concrete placed in the mold and an embossed pattern.

Referring first to FIG. 8, concrete panel 70 includes a plurality of reinforced concrete ribs including 70B integrally formed with concrete face section 70A. As shown in FIG. 8, concrete panel 70 is disposed in a mold 3, wherein concrete panel 70 is formed. Face section 70A is reinforced by steel mesh 55, and rib section 70B is reinforced by steel bar 53, which extends through rib 70B. Mesh 55 is connected to reinforcing bar 53 by means of a plurality of hooked links 54. A nailing strip 51 is anchored into the end or tip of rib 70B by means of a plurality of anchors 52 which are anchored into the concrete of rib 70B and also into nailing strip 51. Concrete panel 70 has a decorative pattern, subsequently described, embossed on the outer face of face section 70A of concrete panel 70.

Figure 7:
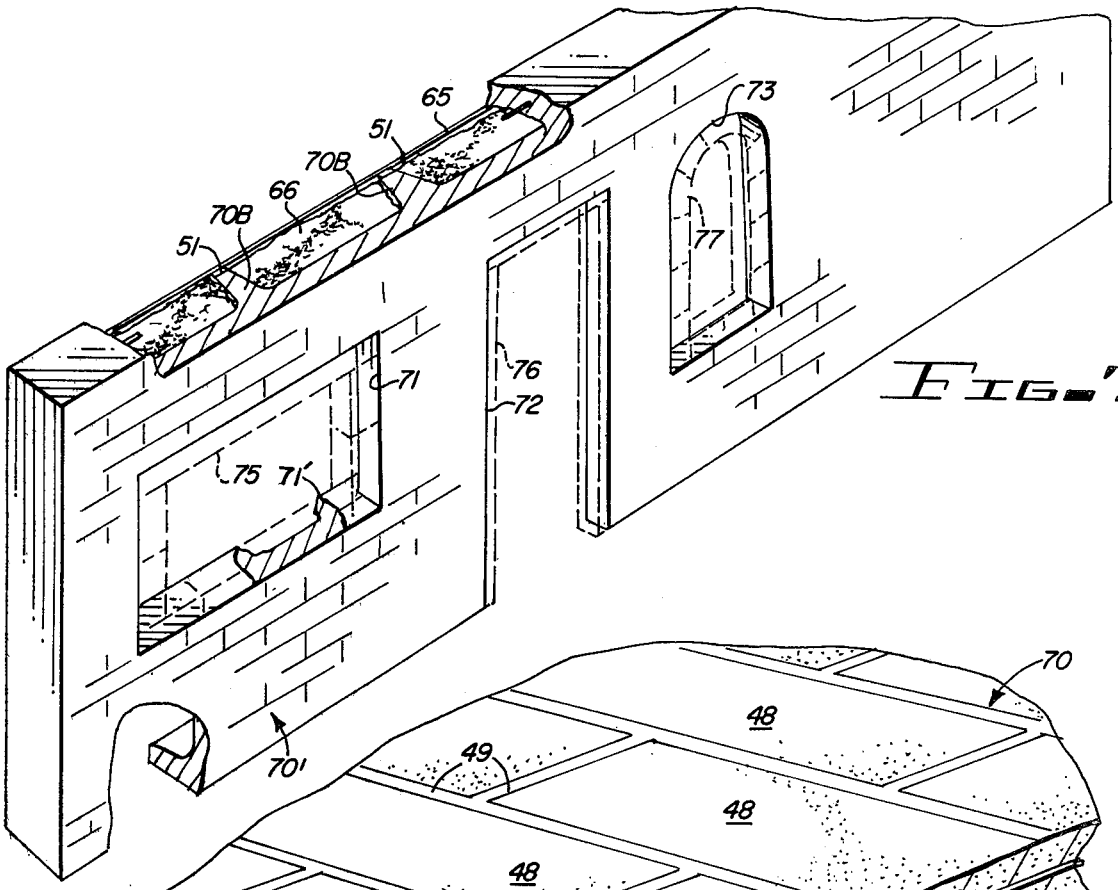
FIG. 7 discloses a partial perspective view of a prefabricated wall consisting of a concrete panel in accordance with the present invention.

FIG. 7 shows a partial sectional view of an entire preformed concrete wall panel designated by reference numeral 70' having a structure similar to that of concrete panel 70 of FIG. 8. Concrete wall panel 70' includes two window openings 71 and 73 and a door opening 72; these openings are determined by a mold (not shown) defining the various reinforcing ribs, window openings, and door opening, wherein wall panel 70' is formed in accordance with the method of the invention, subsequently described in detail herein. After manufacturing concrete wall panel 70', bricks can be installed to form a "frame" for window openings 71 and 73. Reference numerals 75 and 77 indicate dotted lines representing such bricks installed in concrete wall panel 70' to provide frames for window openings 71 and 73, respectively. Similarly, dotted lines 76 designate a subsequently installed brick door frame for door opening 72. A reinforcing "beam" (not shown) containing reinforcing rod is cast over each window and door opening to support the roof weight. Similarly, a sill 71' is cast at the bottom of each window opening. Each of a plurality of ribs designated by reference numeral 70B has a nailing strip designated by reference numeral 51 anchored therein, as previously explained with reference to FIG. 8. Some of the ribs are disposed vertically along the back side of wall 70' at predetermined center-to-center spacings. Others of the ribs are disposed along the back of wall 70' around the window and door openings, and others are disposed along the top and bottom edges of wall 70' to provide top and bottom plates which can be used to bolt wall 70' to a floor structure and to support a roof. Gypsum wall board or the like, designated by dotted lines 65, can be easily installed on the inner face of wall 70' by nailing it to nailing strips 51. Insulation 66 is provided in the space bounded by various ones of ribs 51, gypsum wall board 65 and the inner surface of face plate 70A.

Figure 1:
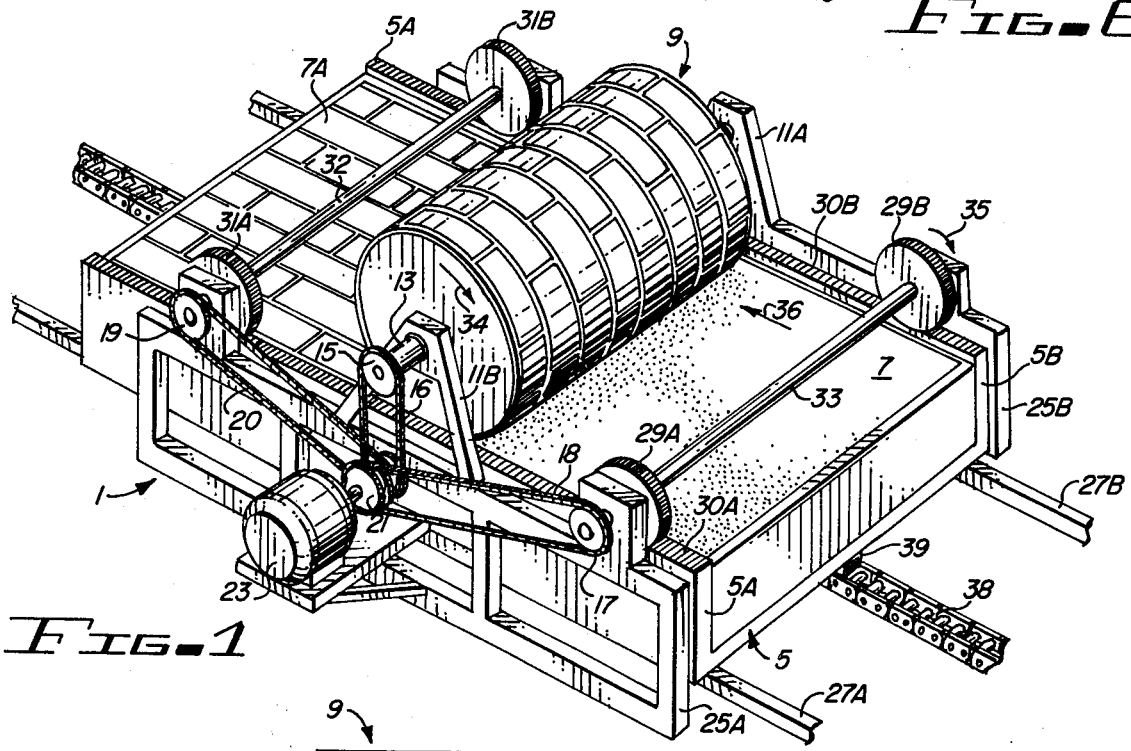
FIG. 1 is a perspective view of a machine for manufacturing preformed concrete building panels according to the method of the present invention.

The presently preferred process for manufacturing the above described preformed concrete building panels involve utilization of the embossing apparatus shown in FIG. 1 to emboss a pattern on moist concrete after it has been poured into a mold having the nailing strips and reinforcing materials of FIG. 8 positioned therein.

Referring now to FIG. 1, embossing machine 1 includes a cylindrical embossing roller 9 supported by means of an axle 13 on a rigid frame having supports designated by reference numerals 25A and 25B. Mold 3, filled with moist concrete 7, is passed between frame supports 25A and 25B while embossing roller 9 rotates so that the surface speed of the pattern on embossing roller 9 moves at the same velocity as the surface of moist concrete 7. The patterned surface of embossing roller 9 presses into the surface of moist concrete 7 and embosses a complementary pattern thereon. It is important that moist concrete 7 have been previously cured or set sufficiently that is is plastically deformable, so that impressions produced by the patterned surface of embossing roller 9 do not change significantly subsequent to the embossing process.

Figure 2:
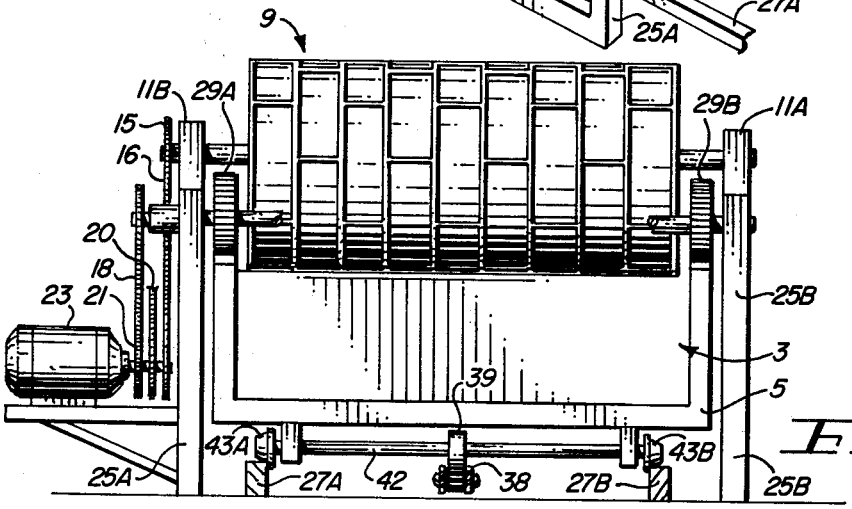
FIG. 2 is an end view of the machine of FIG. 1.

Still referring to FIG. 1, mold 3 and its contents are conveyed beneath rotating embossing roller 9 by means of a carrier 5. Referring now to both FIGS. 1 and 2, it can be seen that carrier 5 is conveyed along a pair of rails 27A and 27B. Carrier 5 includes two wheels 43A and 43B which ride, respectively, on rails 27A and 27B. Wheels 43A and 43B are mounted on axle 42, which is journalled in supports 41A and 41B extending downward from the bottom of carrier 5.

Before carrier 5 passes between support frames 25A and 25B is the direction indicated by arrow 36, carrier 5 is pushed along rails 27A and 27B by means of a moving chain 38 having a pushing element 39 rigidly attached thereto for pushing against the rear end of carrier 5, moving it toward embossing machine 1.

Still referring to FIG. 1, embossing machine 1 includes a first pair of spur gears 29A and 29B connected by axle 33 to gear 17. Gear 17 is driven by means of chain 18 and composite gear 21, which is turned by motor 23. Embossing machine 1 also includes a second pair of spur gears 31A and 31B connected by means of axle 32 to gear 19. Gear 19 is driven by means of chain 20 and composite gear 21. Composite gear 21 also drives gear 15 by means of chain 16. Gear 15 is attached to axle 13 of embossing roller 9.

The two side rails 5A and 5B of carrier 5 have rack gears 30A and 30B, respectively disposed thereon. Gears 21, 19, 15, and 17 are designed so that the surface speed of the pattern on embossing roller 9 moves at precisely the same speed as the teeth on spur gears 29A, 29B, 31A and 31B. Thus, when the leading edge 5A of carrier 5 approaches and contacts spur gears 29A and 29B, the rotation of spur gears 29A and 29B and their consequent engagement with rack gears 30A and 30B, respectively, causes carrier 5 and mold 3 (which is filled with moist, plastically deformable concrete) to move forward at a velocity equal to the surface velocity of embossing roller 9. Thus, the embossing pattern on embossing roller impresses a decorative pattern into the surface of moist concrete 7 without "smearing" the surface of moist concrete 7. (It should be noted that rack gears 30A and 30B can be positioned on the sides or under surface of carrier 5 to avoid the problems of moist concrete being splashed on rack gears 30A and 30B and jamming the gears; spur gears 29A, 29B, 31A and 31B could be re-oriented as required).

The position of embossing roller 9 is such that its embossing surface is pressed into the surface of moist concrete 7 embossing therein a complementary pattern, indicated by reference numeral 7A.

Of course, variations in the embossing apparatus shown in FIG. 1 can be readily made. For example, support 11A, 11B can include pressure determining apparatus (not shown) which regulates the pressure with which embossing roller 9 is pressed into the surface of moist concrete 7. It would be possible to maintain all three stationary during the embossing process and cause support frame 25A, 25B to traverse rails or the like at a speed equal to the surface velocity of embossing roller 9 in order to emboss moist concrete 7 in mold 3. Various other gearing arrangements could also be provided by those skilled in the art.

Figure 6:
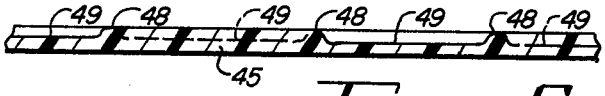
FIG. 6 discloses a sectional view taken along section lines 6—6 of FIG. 3.
Figure 3:
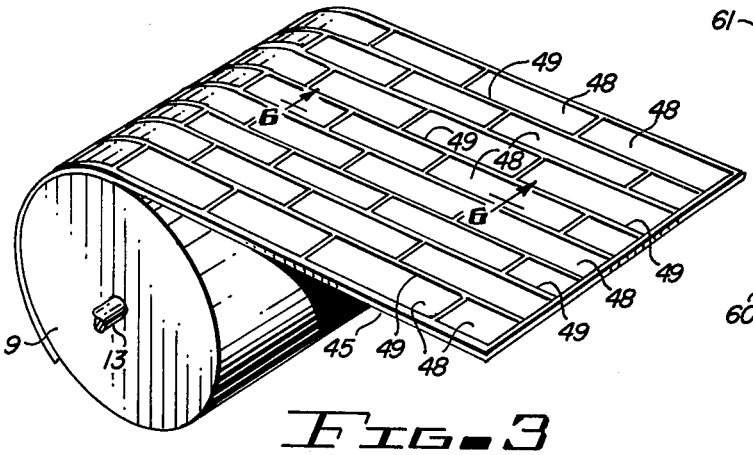
FIG. 3 illustrates the attachment of the embossing sheet to the embossing roller of the machine of FIG. 1.
Figure 5:
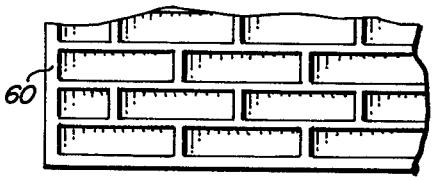
FIG. 5 discloses another wall section having a pattern which can alternatively be transferred to an embossing sheet such as the embossing sheet shown in FIG. 3.

In accordance with an important aspect of the present invention, embossing roller 9 includes a flexible, but durable, plastic embossing sheet 45 wrapped around a cylindrical drum 47 supported on axle 13, as shown in FIG. 3. A partial sectional view of embossing sheet 45, taken along section lines 6—6, is shown in FIG. 6, wherein it is seen that the particular illustrated embossing pattern has the appearance of a brick wall, having a plurality of alternate ridges designated by reference numeral 48 separated by valleys designated by reference numeral 49. The illustrated pattern is substantially identical to the brick wall pattern shown in FIG. 5. According to the present invention, the pattern on the brick wall, a section of which is shown in FIG. 5, is obtained by casting a plastic substance against wall 60 so that the characteristics of wall 60 are reproduced in a complementary pattern formed on the plastic material. The plastically deformable material then may be cured, removed from wall 60, and utilized to produce embossing sheet 45. Alternatively, if the cured deformable plastic material is sufficiently durable, it can be utilized as embossing sheet 45. One suitable material is "Tartan" brand resilient surfacing, manufactured by 3M Company.

Figure 4:
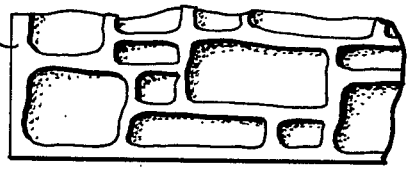
FIG. 4 discloses a portion of a hand constructed wall having a pattern which can be reproduced on the embossing sheet of FIG. 3.

Of course, the same approach can be utilized to obtain a complementary pattern from pre-existing walls. Wall 61 of FIG. 4 illustrates an alternative wall which could be utilized to produce the embossing pattern on embossing sheet 45. Similarly, the wood grain patterns of wood walls, the patterns of various block or rock walls, of stucco walls, of sand blasted walls and the like can also be utilized to provide embossing patterns which have a hand-crafted appearance which is pleasing to home buyers.

Now that the preformed concrete building panel structure and the embossing apparatus have both been described, the process for fabricating the concrete wall panels utilizing the described apparatus will be set forth.

First, the pattern to be embossed upon the outer surface of the preformed concrete panels must be obtained. In order to obtain a pattern which has an appearance of being hand crafted (rather than machine manufactured), a pre-existing wall or a sample wall (such as a slump block wall section or a stone wall section built by a skilled mason) is utilized to obtain the embossing pattern for embossing roller 9. A plastically deformable substance is used as a molding compound and is cast against the wall section so that the plastically deformable substance conforms precisely to the pattern of the wall section. In certain instances, it may be desirable to lay the wall section flat before applying an initially low viscosity plastically deformable substance thereto. Further, in certain instances, it may be desirable to apply anti-sticking substances, such as silicone lubricants, to the wall section before pressing the plastically deformable molding compound thereon. The plastically deformable molding compound is of a type which "cures" with passage of time or addition of curing ingredients, such as "Tartan" brand resilient surfacing, manufactured by 3M Company.

After a suitable curing time the plastic molding substance hardens sufficiently so that it can be "peeled" away from the wall section in such a manner that the complement of the pattern of the wall section is almost perfectly reproduced on the resulting sheet of cured plastic molding compound.

The next step in the process is to utilize the cured molding compound sheet (such as impression sheet 45 in FIG. 3) of sufficient durability for use in the embossing machine 1 of FIG. 1. In certain instances, the above described molding sheet itself may be utilized. If the cured molding compound sheet is not itself sufficiently durable for use for embossing sheet 4 in FIG. 3, then the sheet of cured molding compound must be utilized to produce an impression in yet another plastically deformable material, which is then utilized as a mold to make a durable embossing sheet to be wrapped on cylinder 47 of FIGS. 1 and 3.

Next, the resulting embossing sheet 45 (having a pattern complementary to the pattern of the original wall section) is wrapped around a cylinder.

A plurality of horizontally disposed molds, such as mold 3 in FIG. 8, are prepared by placing nailing strips, such as nailing strip 51, in the bottom of each of the tapered groove sections (such as 3B, 3C, 3D) of each mold. The nailing strips are placed on top of inflatable tubes 56 such that the anchors such as 52 extend upward from each of the nailing strips. Reinforcing bars such as 53 are positioned in each of the rib sections of the respective molds; horizontal reinforcing mesh such as 55 is positioned above the surface 3A of each mold, as indicated. If desired, hooked links 54 can be utilized so that the reinforcing rods 53 are temporarily suspended by the reinforcing mesh 55.

Prior to pouring of the wet concrete into the respective molds, an anti-sticking substance such as silicone lubricant can be sprayed on or otherwise applied to the inner surfaces of the respective molds to ease subsequent separation of the hardened concrete building panels from the molds. Alternatively, (or additionally) a thin layer of plastic sheet can be utilized to line the molds to reduce or prevent sticking of the concrete thereto after it is cured.

Next, wet concrete is placed or poured into the respective horizontally positioned molds and allowed to cure for a predetermined amount of time so that the outer surface of the aggregate is plastically deformable, thereby permitting an embossed pattern to be retained therein (it should be noted that prior to curing of the wet concrete after it has been poured into mold 3, the wet concrete can be made to settle more compactly in mold 3 by either vibrating the mold or by inserting a vibrating probe into the wet concrete.

After the wet concrete has been cured for a suitable amount of time, the molds are conveyed along conveyor tracks 27A and 27B in FIG. 1 by means of moving chain 38 and a plurality of carriers, such as carrier 5. If desired, the molds can be placed in the respective carriers prior to the above described steps of placing reinforcement materials in the molds and pouring of the wet concrete.

As previously explained, motor 23 causes the wet concrete surface to move at a surface velocity equal to the surface velocity of the decorative pattern on embossing sheet 45, so that the surface of the moist, plastically deformable concrete in each mold is embossed as it passes through embossing machine 1.

If moist concrete in the molds has a significant tendency to stick to the embossing sheet, an anti-sticking substance, such as silicone lubricant, can be sprayed either on the embossing surface of embossing drum 9 or on the surface of the mosit concrete before it is contacted by the embossing surface.

As an alternative to spraying silicone lubricant on the embossing surface or on the moist concrete surface, a thin elastic sheet can be placed over the moist concrete surface prior to passing of the mold beneath embossing roller 9. As yet another alternative, both silicone lubricant and a thick plastic sheet can be utilized to counter tendencies of the moist concrete to stick to the embossing surface.

After each mold and mold carrier has completed its pass through embossing machine 1, the molds and their contents are stored for a predetermined amount of further curing, until the aggregate has sufficiently hardened to form the final product, a preformed concrete building panel. The disclosed configuration of mold 3 is convenient for stacking. Thus, relatively small amounts of storage space is required for storing molds containing embossed but unhardened building panels.

A ventilating system, such as a fan, can be utilized to blow hot moist air through the gaps between the ribbed portions of the respective molds. The amount of such hot moist air can be varied to control the curing rate of the moist concrete stored in the respective molds.

Figure 9A:
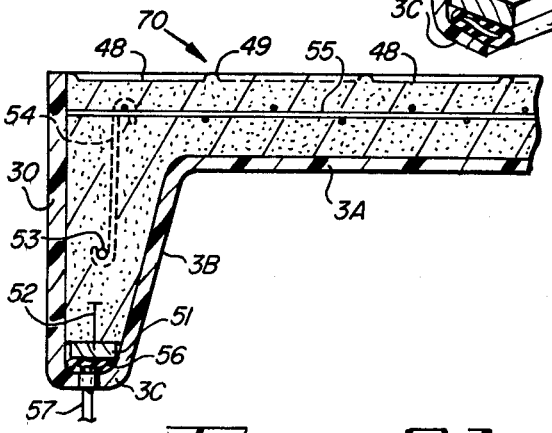
FIG. 9A is a partial sectional view of a mold and portion of concrete building panel therein useful in describing one aspect of the method of the invention.
Figure 9B:
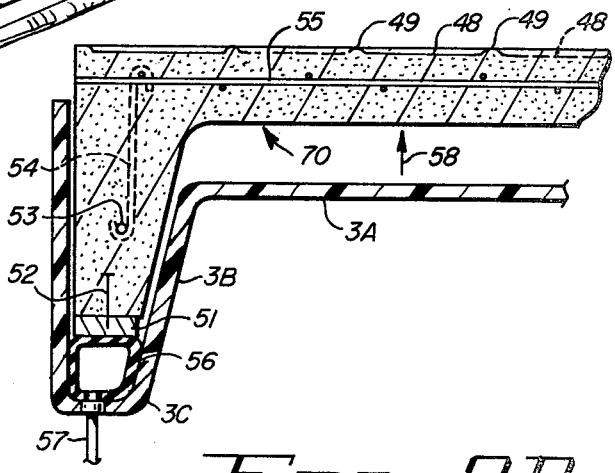
FIG. 9B is a partial sectional view illustrating removal of a concrete building panel from the mold.

After the concrete has hardened sufficiently that it can be separated from the molds without damage to the preformed building panels, the molds can be separated utilizing a variety of techniques, one of which is illustrated in FIGS. 9A and 9B. FIG. 9A illustrates cured building panel 70 prior to removal from mold 3. Air hose 57 is directly connected to inflatable tube 56 and to a source of compressed air (not shown), causing inflatable tube 56 to expand, thereby raising the concrete building panel 70 in the direction indicated by arrow 58 in FIG. 9B. However, other approaches to separating preformed building panels and molds are possible. If the molds are formed from fiberglass, which is fairly flexible, the outer edge 3D (FIG. 9A) can be pried away from the concrete material. Further, lifting hooks can be placed around the edges of mold 3 at the same time that the reinforcing materials are placed therein. Such lifting hooks can then be utilized to lift the panel out of the mold after it has cured. The lifting hooks can then be separated from the concrete building panel and reutilized, as can the molds themselves.

While the invention has been described with reference to a particular embodiment thereof, those skilled in the art will readily recognize that variations in arrangement of elements to provide the desired result may be made without departing from the true spirit and scope of the present invention.

I claim:

1. A method for making prefabricated reinforced concrete panels, said method comprising the steps of:

a. placing rigid reinforcing material in a horizontal, portable mold so that said reinforcing material is supported above the bottom of said horizontal mold, wherein said method includes providing a plurality of tapered rib cavities in said mold for shaping reinforcing ribs in said prefabricated concrete panels, said method further comprising the step of placing nailing strips in the bottoms of said cavities before said placing of said moist concrete in said mold, said nailing strips having upwardly extending anchors therein for anchoring said nailing strips into said respective ribs of said prefabricated concrete wall panels;

b. pouring moist concrete in said horizontal mold, said moist concrete being sufficiently moist to flow around and completely surround said reinforcing material;

c. curing said moist concrete until an upper surface of said moist concrete becomes plastically deformable;

d. rotating an embossing roller having a cylindrical embossing surface having an embossing pattern thereon and pressing a lower portion of said embossing surface into said plastically deformable upper surface of said moist concrete so that a pattern which is a complement pattern of said embossing pattern is embossed into said plastically deformable upper surface of said moist concrete while said moist concrete is in said horizontal mold, the difference between the velocity of said lower portion of said cylindrical embossing surface and said mold being essentially zero to avoid smearing of said plastically deformable upper surface of said moist concrete, wherein said cylindrical embossing surface is provided by wrapping a plastic sheet having said embossing surface thereon around said embossing roller;

e. curing said moist concrete in each of said horizontal molds for a predetermined amount of time, whereby said moist concrete hardens to form said prefabricated concrete panels; and f. separating said prefabricated concrete panels from said molds.

2. The method of claim 1 wherein said embossing roller is stationary and wherein step (d) includes conveying said horizontal mold beneath said roller.

3. The method of claim 1 further including the step of applying an anti-sticking substance to the interior of said mold before step (a).

4. The method of claim 1 wherein said reinforcing material includes metal reinforcing rods and metal reinforcing mesh.

5. The method of claim 1 further including the step of applying an anti-sticking substance to the exposed upper surface of said moist concrete in said mold or to said patterned surface of said embossing roller.

6. The method of claim 1 further including the step of vibrating said moist concrete in said mold before step (d) to cause said moist concrete to settle.

7. The method of claim 1, said method further comprising the step of producing a complementary pattern on a deformable plastic substance by placing said deformable plastic substance in intimate contact with a pre-existing surface having a predetermined pattern thereof, said method further including the step of curing said deformable plastic substance to produce said plastic sheet and removing said plastic sheet from said pre-existing surface so that the pattern on said plastic sheet conforms to and is complementary to said predetermined pattern.

8. The method of claim 1 including providing raised portions in said horizontal mold for producing doors and/or windows in prefabricated concrete panels produced in said horizontal mold.

* * * * *